United States Patent [19]

Hutchinson

[11] 4,361,392

[45] Nov. 30, 1982

[54] IMAGE-TRANSFER METHOD AND APPARATUS

[75] Inventor: William J. Hutchinson, Rochester, N.Y.

[73] Assignee: Eastman Kodak Company, Rochester, N.Y.

[21] Appl. No.: 276,319

[22] Filed: Jun. 22, 1981

[51] Int. Cl.[3] ..... G03D 9/00

[52] U.S. Cl. ..... 354/302; 118/104

[58] Field of Search ..... 354/301, 302, 303, 304, 354/305, 320, 321, 322, 318; 118/70, 104

[56] References Cited

U.S. PATENT DOCUMENTS

| | | | |
|---|---|---|---|
| 2,664,801 | 1/1954 | Eisbein | 354/301 |
| 2,742,838 | 4/1956 | Paulas | 95/89 |
| 3,120,794 | 2/1964 | Gold | 354/301 |
| 3,271,187 | 9/1966 | Chen et al. | 117/102 |
| 3,323,435 | 6/1967 | Kleinstra | 95/89 |
| 3,357,337 | 12/1967 | Land et al. | 95/94 |
| 3,418,912 | 12/1968 | Land et al. | 95/89 |
| 3,769,896 | 11/1973 | Samuels et al. | 95/89 |
| 3,846,808 | 11/1974 | Whall | 354/86 |
| 4,223,991 | 9/1980 | Brenner | 354/302 |

*Primary Examiner*—L. T. Hix
*Assistant Examiner*—Alan Mathews
*Attorney, Agent, or Firm*—R. A. Fields

[57] ABSTRACT

In a diffusion-transfer processor for use with successive pairs of donors and receivers, back-side wetting of the receivers is prevented by (a) passing the meniscus of activator, which collects at the entry nip of the lamination rollers, through a gap between the rollers after exit of each pair from the rollers, and (b) removing the activator passed through the gap from the roller that contacts the back sides of the receivers to dry that roller before contacting the back side of the next receiver.

9 Claims, 7 Drawing Figures

IMAGE-TRANSFER METHOD AND APPARATUS

BACKGROUND OF THE INVENTION

1. Field of the Invention

The invention generally relates to a method and apparatus for transferring a photographic image by diffusion from a donor to a receiver. More particularly, the invention relates to a method and apparatus in which the image is transferred from a donor, treated with liquid activator, to one side of a dry receiver without wetting an opposite side of the receiver.

2. Description Of The Prior Art

In one form, such as disclosed in U.S. Pat. No. 4,223,991, image-transfer processing involves the use of separate donor and receiver sheets. The emulsion-bearing donor is exposed imagewise and is soaked in liquid activator to develop the latent image. The activated wet donor is placed in registration with a dry receiver and the two sheets are fed through a pair of pressure rollers, where they are pressed together, beginning the diffusion transfer of the developed image from the donor to the receiver and wringing excess activator from the donor. When image transfer is completed, usually after several minutes, the donor is peeled from the image side of the receiver to reveal a finished print.

Some of the excess activator removed from the donor collects as a meniscus at the entry nip of the rollers. If the meniscus is allowed to remain in the entry nip after the donor and receiver are fed through the rollers, it will evaporate, leaving a deleterious residue of highly corrosive activator salts at the entry nip, which may eventually damage the rollers or cause them to adhere to one another. When successive pairs of donors and receivers are fed through the rollers, a new meniscus will be transferred to the rollers each time a pair of donor and receivers is introduced into the rollers, causing the roller that contacts the back side of a receiver, i.e. the side of the receiver opposite its image side, to spread activator as a non-uniform thin covering onto the back side. This is undesirable for a number of reasons. For example, the formation of dried activator salts on the back side of a receiver is undesirable from a "cosmetic" standpoint and, in view of the high alkalinity of the salts, touching of them should be avoided. Moreover, activator salts on the back side of a receiver, prevents stacking of several receivers because the salts may transfer from the back side of one receiver to the image side of an adjacent receiver, possibly damaging the image side. More importantly, however, the non-uniform wetting of the back side causes a temperature difference between the wet and dry areas of the back side due to evaporative cooling of the wet areas. This temperature difference produces undesirable differences in image density between the wet and dry areas.

Therefore, there exists a need to keep the back side of each receiver dry during image-transfer processing of successive pairs of donors and receivers. To accomplish this, it has been proposed that the meniscus at the entry nip of the pressure rollers be removed immediately after a pair of donor and receivers is fed through the rollers. In U.S. Pat. No. 3,271,187, an endless web surrounds the roller that contacts the back side of each receiver. The web has a diameter substantially greater than that of the roller it surrounds, is sufficiently rigid to retain its cylindrical shape, and includes a plurality of minute openings for entrapping the liquid comprising the meniscus as the rollers are rotated. The liquid entrapped in the openings is expelled from the openings by passing a gas through them. Such an arrangement may not be satisfactory. For example, it is relatively expensive, and the roller that contacts the back side of each receiver may become wet from any mist produced by gas-expelling the liquid from the openings in the web. In U.S. Pat. No. 3,357,337, the roller that contacts the back side of each receiver includes a plurality of radial openings connected with a vacuum source. When the rollers are rotated in contact with one another, following exit of a donor and receiver from between the rollers, the liquid comprising the meniscus is drawn from the roller nip through the radial openings, leaving the rollers substantially dry. Again, such an arrangement is expensive and may not be satisfactory in other respects. For example, the radial openings in the roller can produce a non-uniform surface pressure on a donor and receiver, which may undesirably affect imaging on the receiver.

SUMMARY OF THE INVENTION

The above-described problems associated with image-transfer processing of donors and receivers are believed solved by the invention. Specifically, the invention is an improved method and apparatus for transferring an image from a liquid-treated donor to the front, i.e., image, side of a dry receiver without wetting the back side of the receiver. The donor and receiver may be separate sheets or may be discrete layers of a composite sheet.

In keeping with the teachings of the invention, there is provided in a method of transferring images from successive liquid-treated donors to the front sides of successive receivers without wetting the back sides of the receivers, wherein each pair of the donors and receivers is fed between pressure rollers with the front side of each receiver contacting a donor and the back side contacting one of the rollers, in the course of which excess liquid is removed from the donor and after each pair exits from the rollers a residue of the removed liquid remains at an entry nip of the rollers, the improvement comprising:

passing the residue of liquid through a gap between the rollers following exit of each pair from the rollers; and removing liquid passed through the gap from the roller that contacts the back sides of the receivers to prevent that roller from wetting the back side of the next succeeding receiver.

Consistent with the improved method, there is provided improved apparatus comprising:

means supporting the rollers to provide a gap which is less than the thickness of a pair of the donors and receivers, for allowing the residue of liquid to pass between the rollers in the absence of a pair between them; and means for removing liquid passed through the gap, from the roller that contacts the back side of each receiver, to dry that roller before it contacts the back side of the next succeeding receiver.

Preferably, the liquid removing means includes a squeegee member located in wiping contact with the roller that contacts the back side of each receiver. Moreover, the roller contacting the squeegee member is relatively hydrophilic and the other roller is relatively hydrophobic, causing the hydrophilic roller to convey the residue of liquid through the gap to the squeegee member as the hydrophilic roller is rotated.

DESCRIPTION OF THE PREFERRED EMBODIMENT

GENERAL

The known general terms "donor" and "receiver" as used in this application refer to film and paper, respectively, or their equivalents, for a diffusion-transfer process and may comprise either: separate film and paper sheets that are first laminated together to permit image-transfer and then separated; or discrete film and paper layers of a composite sheet that are separated after image-transfer.

Figure 1:
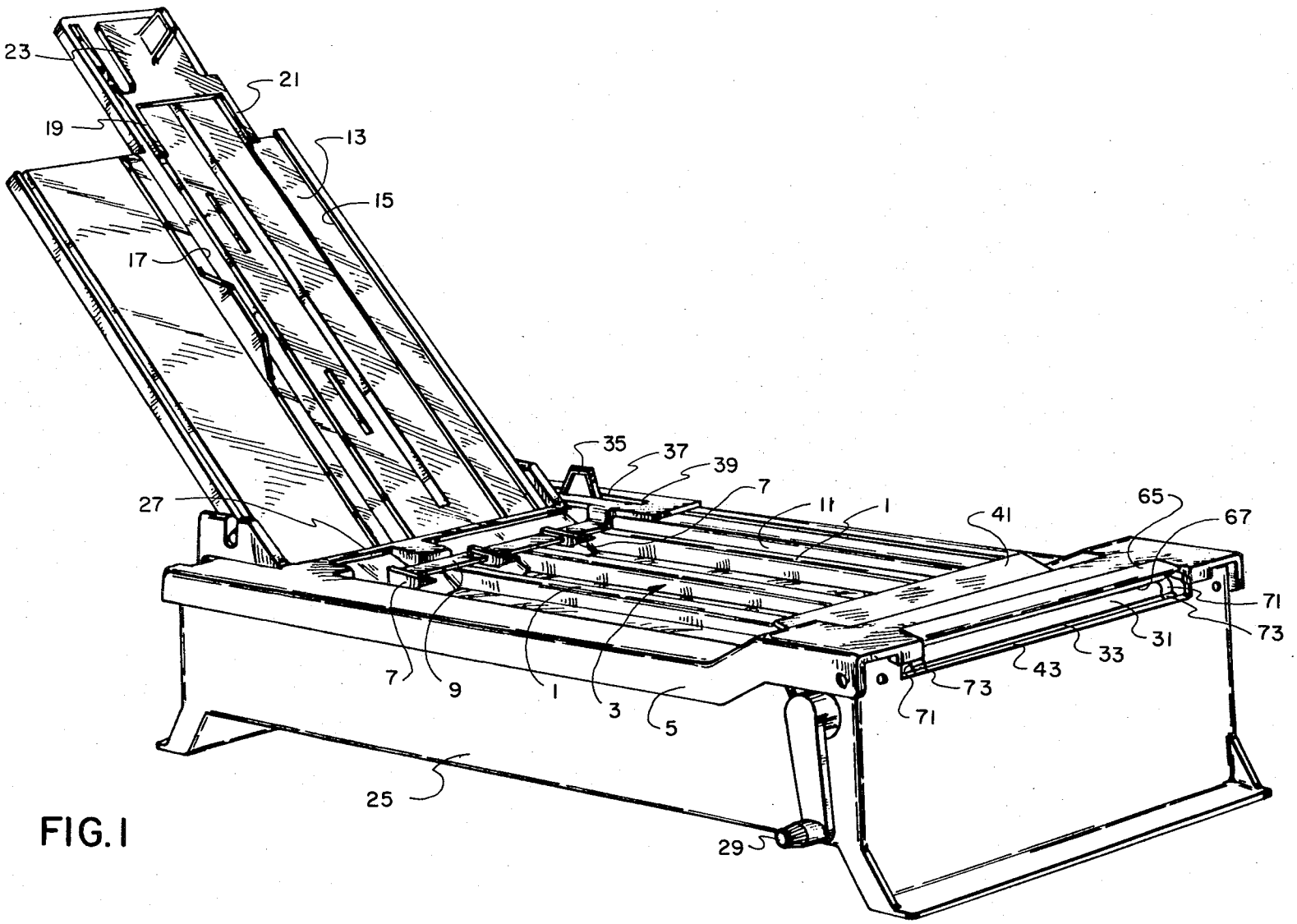
FIG. 1 is a perspective view of an image-transfer processor in accordance with a preferred embodiment of the invention.

Referring now to FIG. 1 of the drawings, there is shown an image-transfer processor for making several size color prints from color negatives and slides. The color negatives are exposed onto a donor sheet of negative film and the slides are exposed onto a donor sheet of reversal film. Then, in the processor, the exposed film is soaked in a water-based activator solution to develop the latent image. After several seconds, the soaked film is laminated to a receiver sheet of dry print paper, which begins the diffusion transfer of the developed image from the film to the paper. In a few minutes, the laminated film and paper are manually peeled apart to reveal a finished color print on the paper.

THE PROCESSOR

Figure 2:
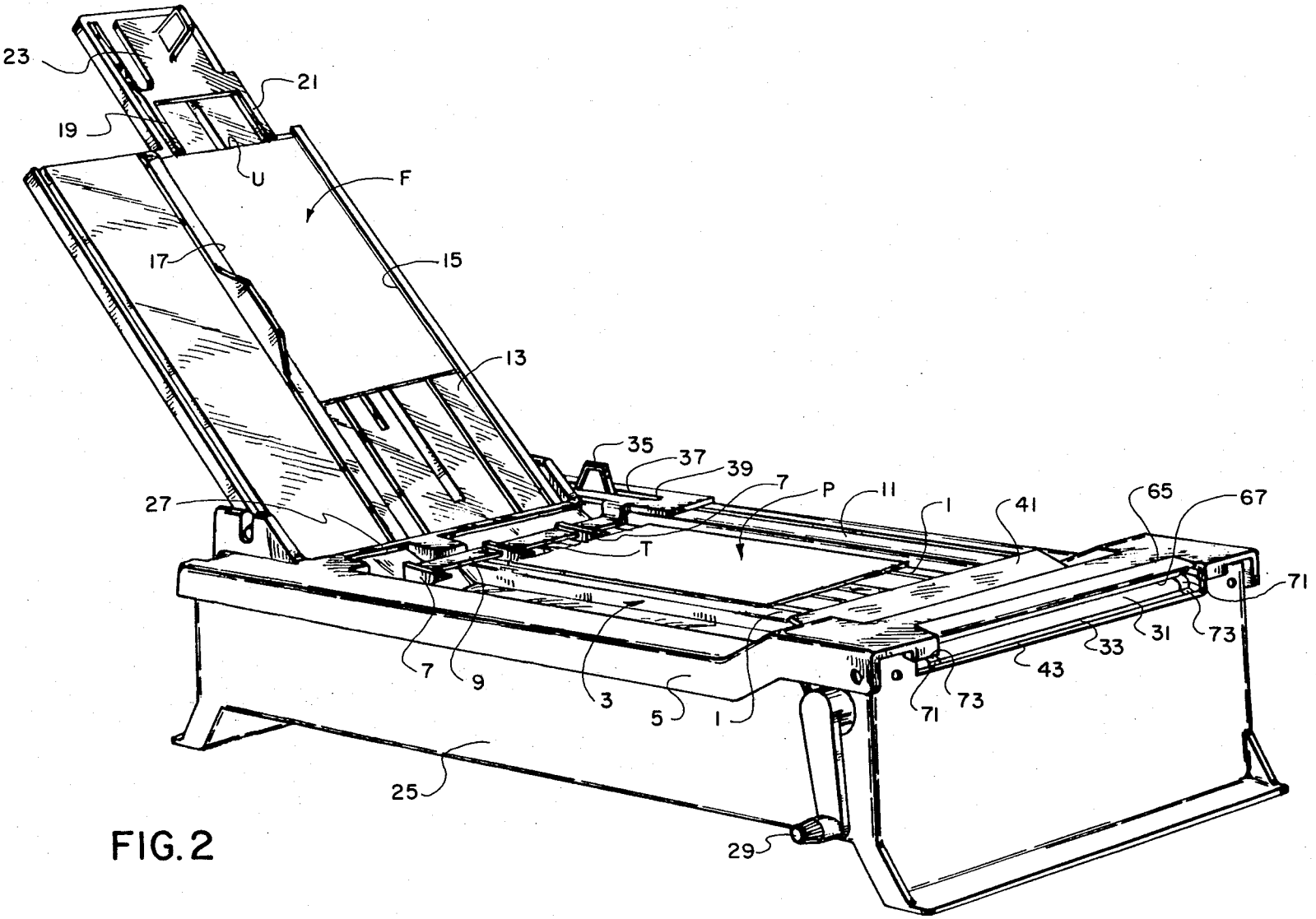
FIG. 2 is a view similar to FIG. 1, showing an exposed donor sheet placed on a donor ramp of the processor and a receiver sheet placed on a receiver shelf of the processor.

To operate the processor, as shown in FIG. 2, a sheet of print paper P is placed emulsion, i.e., front, side down on several upstanding ribs 1, which define a paper feed shelf 3 of a pivotally mounted cover 5. A trailing edge T of the paper P is inserted under two or more tines 7 of a paper advance rake 9, depending on paper width, and one longitudinal edge of the paper is located against a fixed paper edge guide 11. The tines 7 extend between respective pairs of the upstanding ribs 1 to hold the paper P at its trailing edge T. A sheet a exposed film F is placed emulsion side up on a film loading ramp 13. The respective longitudinal edges of the film are inserted under a fixed film edge guide 15 and a movable film edge guide 17. An upper edge U of the film is inserted under two tines 19 and 21 of a film loading ramp slide 23. The edge guide 17 is adjustable to accommodate several size film sheets, and the ramp slide 23 is releasably held in place by several clips, not shown, on the ramp 13. A relatively light spring, not shown, may be included to help keep the film F from sliding down the ramp 13.

Figure 3:
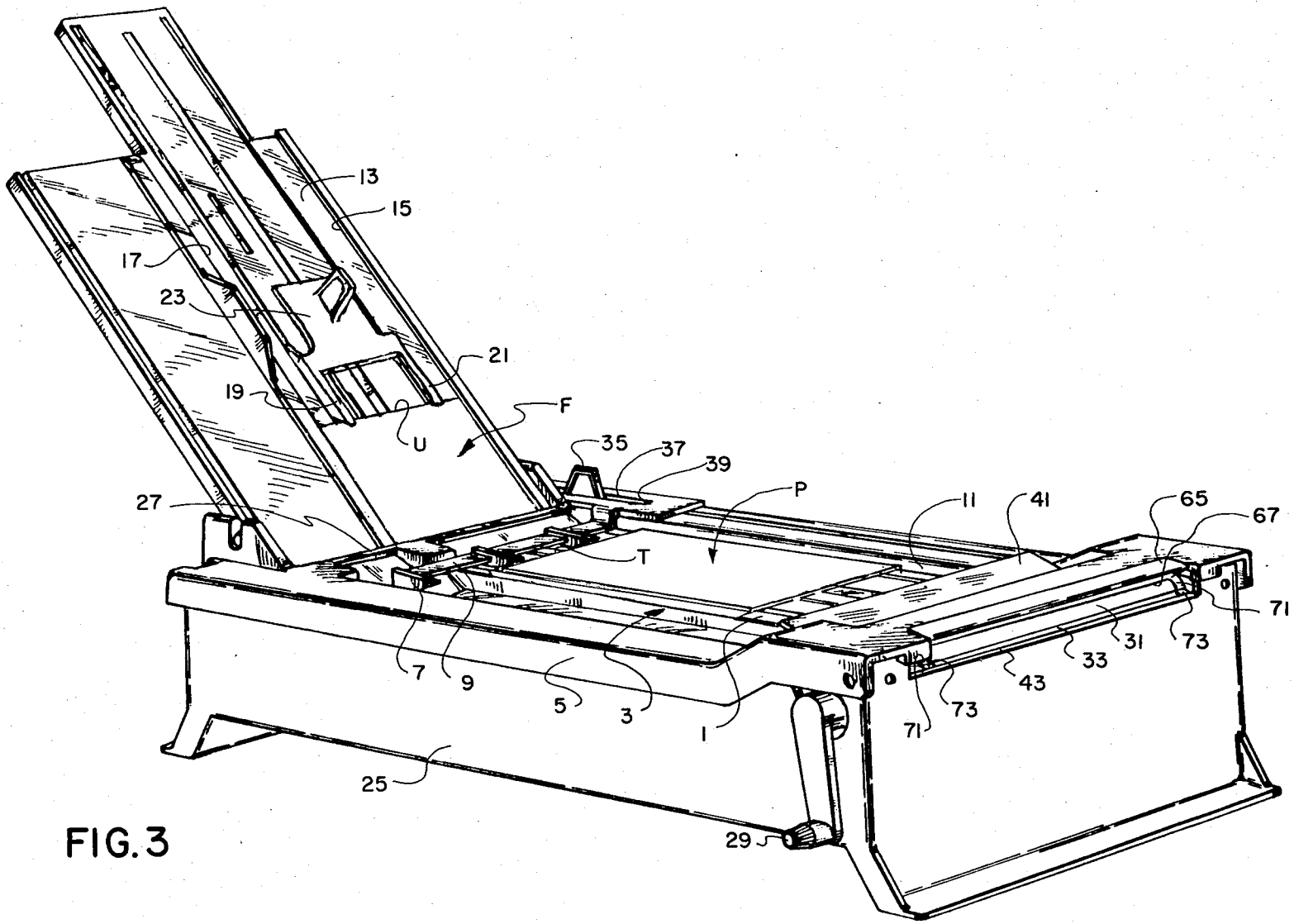
FIG. 3 is a view similar to FIG. 1, showing how the donor is guided into a tray filled with liquid activator in the processor.
Figure 4:
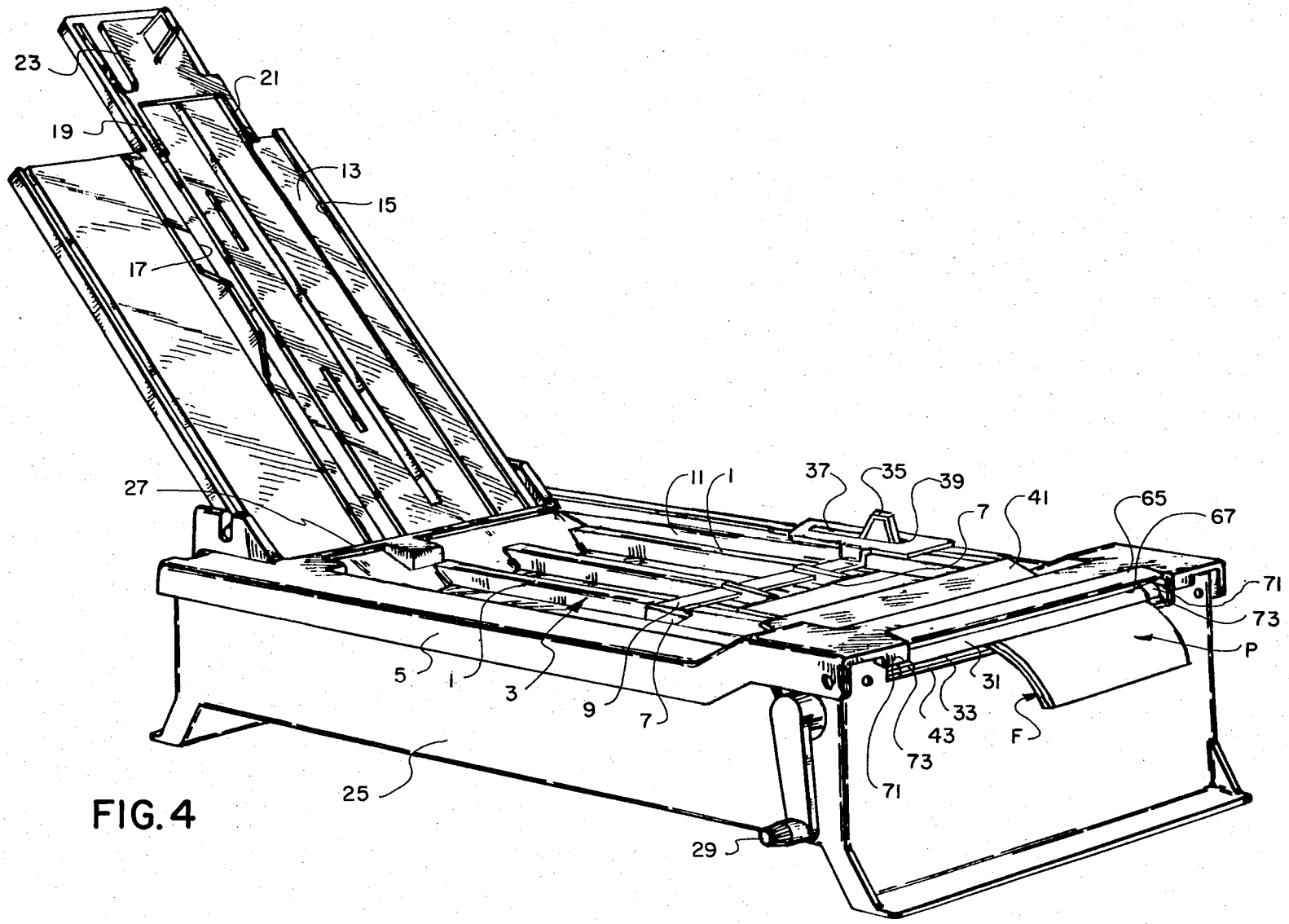
FIG. 4 is a view similar to FIG. 1, showing how the donor treated with activator and the dry receiver are fed through lamination rollers, where they are pressed together, beginning the transfer of the developed image from the donor to the receiver and wringing excess activator from the donor.

To immerse the film F in the activator solution in a solution tray 25, beneath the cover 5, the ramp slide 23 is moved down the loading ramp 13, as shown in FIG. 3. This advances the film F through a film entry slot 27 in the cover 5, and onto a plurality of support ribs, not shown, beneath the level of the activator solution in the tray 25. As soon as the film is completely immersed in the activator solution, the slide 23 may be moved back up the ramp 13, until it locks under the holding clips, not shown. At the end of the activator soak time, e.g., 20 seconds at room temperature, or several seconds before, rotation of a hand crank 29 in a clockwise direction, as viewed in FIG. 4, is begun. This causes an upper lamination roller 31 and a lower lamination roller 33, adjacent a film exit side of the solution tray 25, to rotate in counterclockwise and clockwise directions, respectively, as viewed in FIG. 4. Once the soak time is complete, a film advance rake handle 35 is moved towards the rotating rollers 31 and 33. The handle 35 is fixed to a film advance rake, not shown, beneath the cover 5, and, as shown in FIG. 4, extends through a slot 37 in the paper advance rake 9. After the handle 35 is moved a few inches to one end 39 of the slot 37, it pushes the paper advance rake 9 along the paper feed shelf 3 in unison with movement of the film advance rake along the solution tray 25. Movement of the film advance rake is begun before movement of the paper advance rake to substantially equalize the respective paths taken by the film and paper into the lamination rollers. The paper P is advanced by the paper rake 9 through a paper entry slot, not shown, beneath a pivotally mounted paper feed guide 41 on the cover 5, and arrives at the rollers in registration with the film P. After the film F and the paper P enter the lamination rollers 31 and 33, movement of the rake handle 35 is stopped; however, rotation of the hand crank 29 is continued until the laminated film and paper are completely out of a laminate exit slot 43, adjacent the rollers. As the film and paper are moved through the lamination rollers, preferably in the range of 2 in./sec. to 10 in./sec., they are sandwiched together, beginning the transfer of the developed image by diffusion from the film to the paper and wringing excess activator solution from the film into a catch tray, not shown, beneath the rollers. When lamination time is complete, e.g., six to fifteen minutes depending on room temperature, the film is peeled from the paper to reveal a finished color print.

THE LAMINATION ROLLERS

As excess activator is removed from the film sheet F by passage through the lamination rollers 31 and 33, in FIG. 4, some of the removed solution collects as a meniscus between the film and the lower roller. This meniscus remains at the entry nip of the rollers after the film and paper have exited from the rollers.

Figure 5:
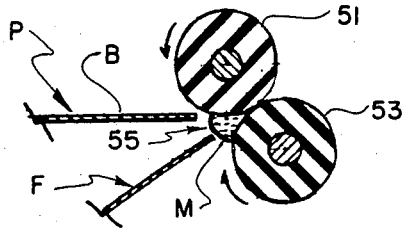
FIG. 5 (PRIOR ART)
FIG. 5 is an elevational sectional view of prior art lamination rollers, showing a meniscus at the entry nip of the rollers, which is formed from excess activator removed from a donor.

When, in prior art apparatus, such as illustrated in FIG. 5, successive pairs of the film F and the paper P are advanced through lamination rollers 51 and 53 that are normally in contact with one another, movement of a pair of the film and paper into the entry nip 55 of the rollers causes some of the meniscus M of activator at the entry nip to be immediately smeared back over the dry back side B of the paper. The remainder of the meniscus M transfers to the rollers, causing the upper roller 51, which contacts the back side B of the paper, to spread activator solution as a non-uniform thin covering onto the back side. This is undesirable for the reasons stated above in the Description Of The Prior Art.

Figure 6:
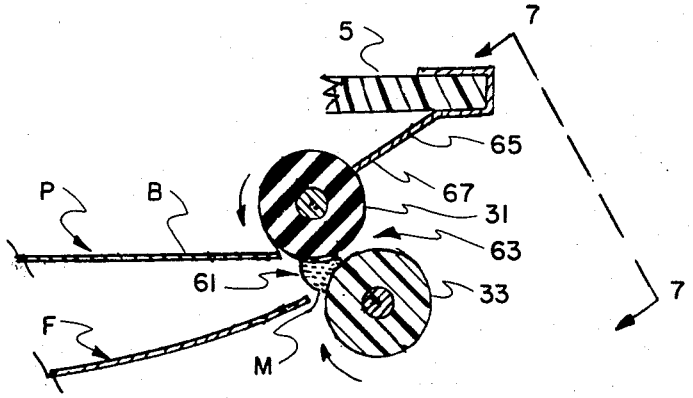
FIG. 6 is an elevational sectional view of the lamination rollers and a squeegee member in the processor of FIG. 1.
Figure 7:
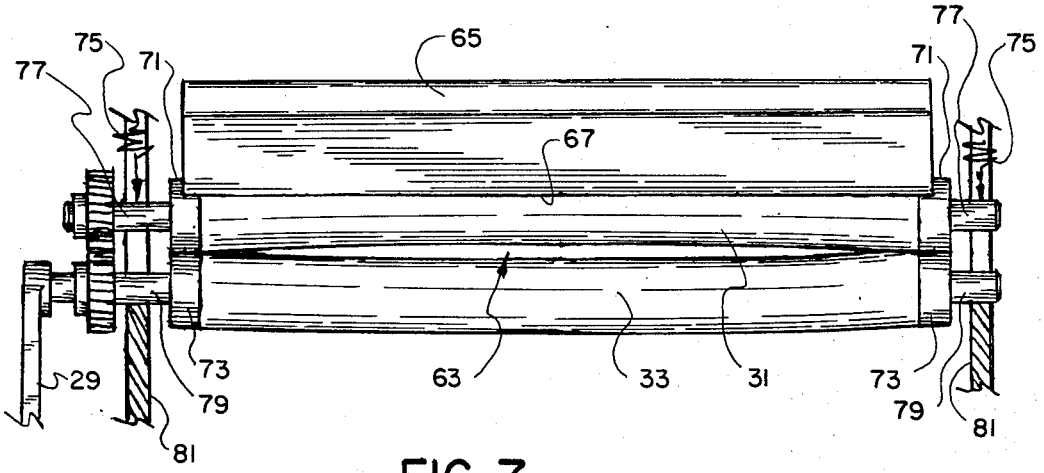
FIG. 7 is an elevational sectional view of the lamination rollers and the squeegee member as seen in the direction of the arrows from the lines 7—7 in FIG. 6.

According to the invention, which is shown in FIGS. 6 and 7, such back-side wetting of the paper is prevented by (a) passing the meniscus M of activator at the entry nip 61 of the lamination rollers 31 and 33 through a permanent gap 63 between the rollers ahead of each pair of the film and paper and (b) removing the activator solution passed through the gap from the roller that contacts the back side B of the paper, i.e., the upper roller 31, to dry that roller before contacting the back side of the next receiver.

As shown in FIG. 6, the means for removing activator solution from the upper roller 31 comprises a squeegee blade 65, mounted on the cover 5 and having a free end 67 disposed in wiping contact with the upper roller. The squeegee blade 65 can be constructed from a suitable thin flexible material, such as stainless steel, and must provide enough force against the upper roller to wipe-off activator solution on the roller. Typically, the viscosity of the activator solution is close to that of water, e.g., 1.03 centipoise.

The means for providing the permanent gap 63 between the upper and lower rollers 31 and 33 is shown in FIG. 7 and comprises a first pair of collars or spacers 71, at opposite ends of the upper roller, and a second pair of collars or spacers 73, at opposite ends of the lower roller. As distinguished from the rollers 31 and 33, which are constructed of a compliant material, the collars 71 and 73 are constructed of a non-compliant material, such as "Celcon", which is a trademark for an acetal copolymer. The gap 63 is less than the combined thickness of the film F and the paper P and may vary, for example, from 0.001" to 0.009". The collars 71 and 73 are maintained in contact with one another by the compressive force of two springs 75 that bear against a central flexible shaft 77 of the upper roller 31, adjacent the opposite ends of the shaft, as shown in FIG. 7. A flexible central shaft 79 of the lower roller 33 is supported by two upstanding bearing ribs 81, adjacent the opposite ends of the shaft. Such an arrangement causes a slight bowing of both rollers 31 and 33, as shown in FIG. 7, making the gap 63 widest midway between the opposite ends of the rollers.

The upper roller 31 is hydrophilic, i.e., has a strong affinity for the water-based activator solution; whereas, the lower roller 33 is hydrophobic, i.e., lacks any affinity for the activator solution. When the upper and lower rollers are rotated without the film F and the paper P between them, as depicted in FIG. 6, the meniscus M of activator solution at the entry nip 61 will be conveyed by the upper roller over the lower roller, through the gap 63, to the free end 67 of the squeegee blade 65. The squeegee blade 65 wipes successive surface portions of the rotating roller 31 dry before they contact the back side B of the paper P, in FIG. 6.

The invention has been described in detail with particular reference to a preferred embodiment thereof, but it will be understood that variations and modifications can be effected within the spirit and scope of the invention.

I claim:

1. In a method of transferring images from successive liquid-treated donors to the front sides of successive receivers without wetting the back sides of the receivers, wherein each pair of the donors and receivers is fed between pressure rollers with the front side of each receiver contacting a donor and the back side contacting one of the rollers, in the course of which excess liquid is removed from the donor and after each pair exits from the rollers a residue of the removed liquid remains at an entry nip of the rollers, the improvement comprising:

passing the residue of liquid through a gap between the rollers following exit of each pair from the rollers; and removing liquid passed through the gap from the roller that contacts the back sides of the receivers to prevent that roller from wetting the back side of the next succeeding receiver.

2. The improvement as recited in claim 1, wherein the residue of liquid is passed through the gap by rotating the rollers to draw the residue through the gap.

3. The improvement as recited in claim 1, wherein one of the rollers is relatively hydrophilic and the other roller is relatively hydrophobic, and the residue of liquid is passed through the gap by rotation of the hydrophilic roller to convey the residue through the gap.

4. The improvement as recited in claim 3, wherein the residue of liquid conveyed through the gap is removed from the rotating hydrophilic roller by wiping that roller.

5. The improvement as recited in claim 1, wherein the residue of liquid is passed through the gap by moving a pair of the donors and receivers through the gap, which causes respective leading edges of the pair to push the residue through the gap.

6. In a method of transferring images from successive liquid-treated donors to the front sides of successive receivers without wetting the back sides of the receivers, wherein each pair of the donors and receivers is fed between pressure rollers with the front side of each receiver contacting a donor and the back side contacting one of the rollers, in the course of which excess liquid is removed from the donor and after each pair exits from the rollers a residue of the removed liquid remains at an entry nip of the rollers, the improvement comprising:

passing the residue of liquid through a gap between the rollers, which is less than the thickness of a pair of the donors and receivers, by rotating the rollers in the absence of a pair between them; and removing liquid passed through the gap, from the roller that contacts the back sides of the receivers, to dry that roller before it contacts the back side of the next succeeding receiver.

7. In apparatus for transferring images from successive liquid-treated donors to the front sides of successive receivers without wetting the back sides of the receivers, wherein juxtaposed rollers press each pair of the donors and receivers between them with the front side of each receiver contacting a donor and the back side contacting one of said rollers, in the course of which excess liquid is removed from the donor and after each pair exits from the rollers a residue of the removed liquid remains at an entry nip of said rollers, the improvement comprising:

means supporting said rollers to provide a gap between them which is less than the thickness of a pair of the donors and receivers, for allowing the residue of liquid to pass between said rollers in the absence of a pair between them; and means for removing liquid passed between said rollers, from the roller that contacts the back sides of the receivers, to dry said roller before it contacts the back side of the next succeeding receiver.

8. The improvement as recited in claim 7, wherein the roller that contacts the back sides of the receivers is relatively hydrophilic and the other roller is relatively hydrophobic, causing the hydrophilic roller to convey the residue of liquid through the gap as the hydrophilic roller is rotated.

9. The improvement as recited in claim 7, wherein said liquid removing means includes a squeegee member located in wiping contact with the roller that contacts the back sides of the receivers, and said roller is relatively hydrophilic and the other roller is relatively hydrophobic, causing the hydrophilic roller to convey the residue of liquid through the gap to said squeegee member as the hydrophilic roller is rotated.

* * * * *